US012392509B2

(12) United States Patent
Cheng et al.

(10) Patent No.: US 12,392,509 B2
(45) Date of Patent: Aug. 19, 2025

(54) COIL ASSEMBLY PLATE WITH COMPENSATOR ACCOMMODATION

(71) Applicant: Johnson Controls Tyco IP Holdings LLP, Milwaukee, WI (US)

(72) Inventors: Xianjin Cheng, Andover, KS (US); Amr Maher Abdellati Aly, Wichita, KS (US)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 118 days.

(21) Appl. No.: 18/232,074

(22) Filed: Aug. 9, 2023

(65) Prior Publication Data

US 2024/0053030 A1 Feb. 15, 2024

Related U.S. Application Data

(60) Provisional application No. 63/396,520, filed on Aug. 9, 2022.

(51) Int. Cl.
*F24F 3/00* (2006.01)
*F24F 3/06* (2006.01)

(52) U.S. Cl.
CPC ..... *F24F 3/001* (2013.01); *F24F 3/06* (2013.01)

(58) Field of Classification Search
CPC ..... F25B 2345/00; F25B 45/00
USPC ..... 165/50
See application file for complete search history.

(56) References Cited

FOREIGN PATENT DOCUMENTS

WO WO-2015056635 A1 * 4/2015 ..... F25B 13/00

* cited by examiner

*Primary Examiner* — Steve S Tanenbaum
(74) *Attorney, Agent, or Firm* — Fletcher Yoder, PC

(57) ABSTRACT

A heating, ventilation, and/or air conditioning (HVAC) system includes a refrigerant circuit configured to circulate refrigerant. The circuit includes a compressor, an indoor heat exchanger, an outdoor heat exchanger, and a reversing valve that transitions between a first configuration to direct the refrigerant from the compressor toward the outdoor heat exchanger and a second configuration to direct the refrigerant from the compressor toward the indoor heat exchanger. The system includes a compensator with a conduit that is part of the refrigerant circuit and configured to pass the refrigerant therethrough and a chamber disposed about the conduit. The chamber is also communicatively coupled to the refrigerant circuit, and configured to retain a portion of the refrigerant in the chamber. A coil assembly plate of the indoor heat exchanger or the outdoor heat exchanger includes a receptacle configured to receive the refrigerant charge compensator.

20 Claims, 6 Drawing Sheets

COIL ASSEMBLY PLATE WITH COMPENSATOR ACCOMMODATION

CROSS-REFERENCE TO RELATED APPLICATIONS

This application claims priority from and the benefit of U.S. Provisional Application Ser. No. 63/396,520, entitled "DELTA PLATE FOR COMPENSATOR FOR INDOOR MICROCHANNEL EVAPORATOR COIL," filed Aug. 9, 2022, which is herein incorporated by reference in its entirety for all purposes.

BACKGROUND

Residential, light commercial, commercial, and industrial heating, ventilation and/or air conditioning (HVAC) systems are used to control temperatures and air quality in residences and buildings. Generally, HVAC systems may circulate a refrigerant (also referred to as a working fluid) through a closed refrigeration circuit between an evaporator, where the refrigerant absorbs heat, and a condenser, where the refrigerant releases heat. When the HVAC system is an air conditioner or a heat pump in a cooling mode, an indoor heat exchanger disposed in a climate controlled space operates as the evaporator and an outdoor heat exchanger operates as the condenser. Thus, the climate controlled space is cooled by the process. A heat pump operating in a heating mode switches this operation. That is, the outdoor heat exchanger operates as the evaporator and the indoor heat exchanger operates as the condenser. Thus, the climate controlled space is warmed by the process.

The refrigerant flowing within a HVAC system travels through multiple conduits and components of the refrigerant circuit and is generally formulated to undergo phase changes within normal operating temperatures and pressures of the system so that desired quantities of heat can be exchanged by virtue of the latent heat of vaporization of the refrigerant. However, operating in different modes can cause system imbalances. Further, traditional techniques for addressing such imbalances can create other inefficiencies. Accordingly, there is a need for new and improved systems and methods for handling refrigerant flows in an efficient manner.

SUMMARY

In an embodiment of a heating, ventilation, and/or air conditioning (HVAC) system includes a refrigerant circuit configured to circulate refrigerant. The circuit includes a compressor, an indoor heat exchanger, an outdoor heat exchanger, and a reversing valve that transitions between a first configuration to direct the refrigerant from the compressor toward the outdoor heat exchanger and a second configuration to direct the refrigerant from the compressor toward the indoor heat exchanger. The system includes a compensator with a conduit that is part of the refrigerant circuit and configured to pass the refrigerant therethrough and a chamber disposed about the conduit. The chamber is also communicatively coupled to the refrigerant circuit, and configured to retain a portion of the refrigerant in the chamber. A coil assembly plate of the indoor heat exchanger or the outdoor heat exchanger includes a receptacle configured to receive the refrigerant charge compensator.

In an embodiment, a heat pump system includes a compressor of a refrigeration circuit, wherein the compressor is configured to drive refrigerant through the refrigeration circuit. The system also includes an indoor heat exchanger, an outdoor heat exchanger, and a reversing valve that operates to transition between a first configuration to direct the refrigerant from the compressor toward the outdoor heat exchanger and a second configuration to direct the refrigerant from the compressor toward the indoor heat exchanger. A refrigerant charge compensator including a conduit disposed along the refrigerant circuit and a chamber surrounding the conduit that is fluidly coupled to the refrigerant circuit is also included. Further, a coil assembly plate of the indoor heat exchanger or the outdoor heat exchanger includes a receptacle configured to receive the refrigerant charge compensator.

In an embodiment, a heating, ventilation, and/or air conditioning (HVAC) system includes a heat exchanger, a first slab of the heat exchanger, a second slab of the heat exchanger, and coil assembly plates coupled to the first slab and the second slab such that an interior space is defined between the first slab, the second slab, and the coil assembly plates. The interior space is configured to guide airflow through the heat exchanger. The system also includes a receptacle in one coil assembly plate of the coil assembly plates, wherein the receptacle houses a refrigerant charge compensator such that a portion of the refrigerant charge compensator extends into the interior space.

Other features and advantages of the present application will be apparent from the following, more detailed description of the embodiments, taken in conjunction with the accompanying drawings which illustrate, by way of example, the principles of the application.

DETAILED DESCRIPTION

Figure 1:
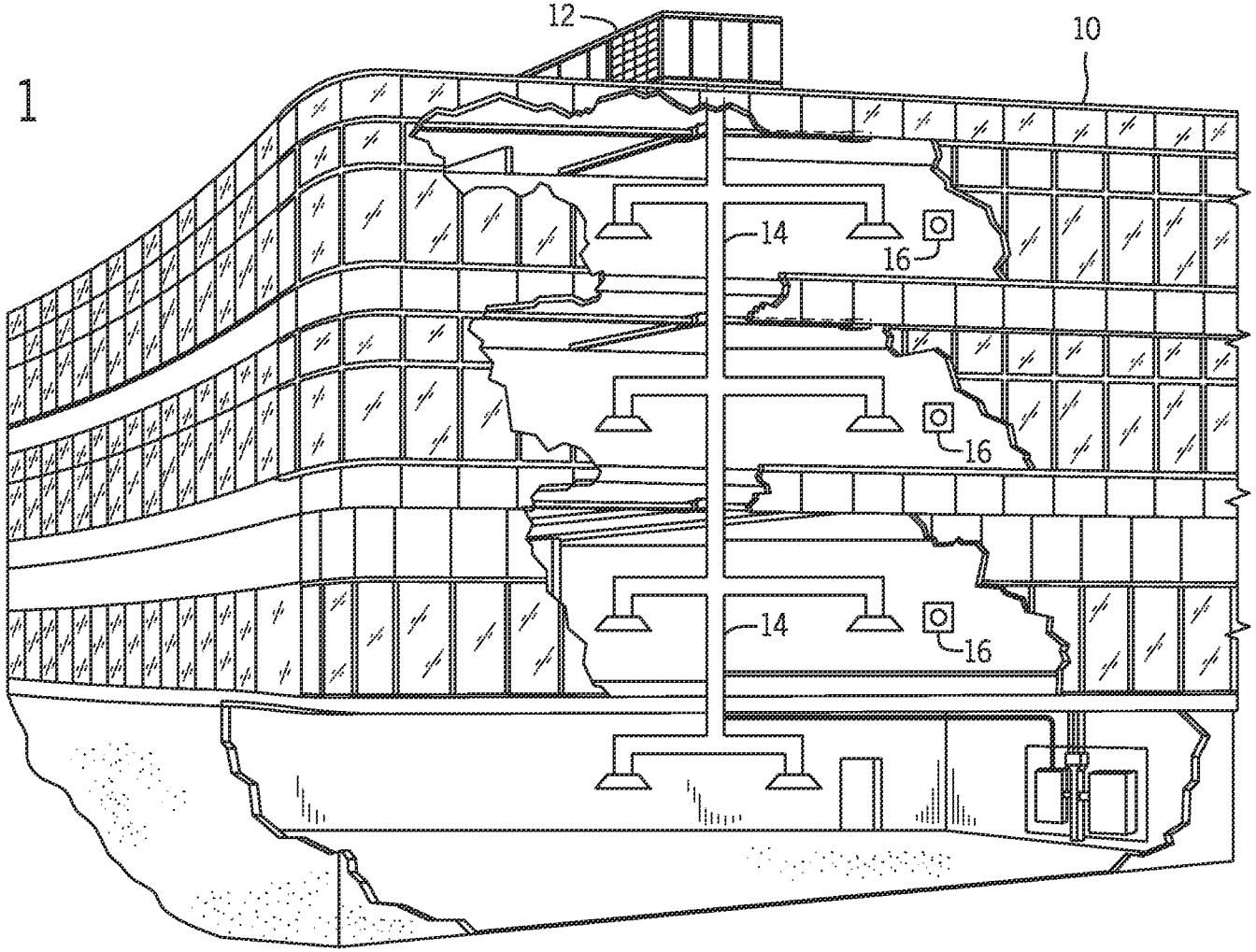
FIG. 1 is a perspective view of a building having a HVAC system, in accordance with an embodiment of the present disclosure.

The present disclosure relates generally to a heating, ventilation, and/or air conditioning (HVAC) system with an indoor heat exchanger (e.g., an indoor coil) and an outdoor unit, which includes an outdoor heat exchanger (e.g., an outdoor coil). The HVAC system may be a heat pump, wherein cooling operations and heating operations generally require different volumes of refrigerant due to operational differences (e.g., differences in indoor and outdoor heat exchanger sizes and utilization as a condenser or evaporator). For example, it is now recognized that heating mode operation of heat pumps can result in liquid refrigerant stacking up in the system. A substantial amount of the refrigerant charge for the system can back up into the indoor heat exchanger during such operation. This stacked up refrigerant creates inefficiencies, such as limiting refrigerant flow due to increased discharge pressure and corresponding inefficient heat exchange. Accordingly, to address such issues, an HVAC system may employ a refrigerant charge compensator (also herein referred to as a compensator) disposed along the refrigerant flow path to increases system efficiency by storing excess refrigerant during heating mode operation and returning refrigerant back into circulation during cooling mode operation.

A refrigerant charge compensator may include a conduit surrounded by a chamber. The conduit can be integrated along the refrigerant circuit and may extend through the inside of the chamber. The chamber surrounds the conduit and includes an inlet or port that can receive at least a portion of the excess refrigerant charge into the chamber. In a traditional configuration, the conduit of the compensator couples with the outdoor heat exchanger such that refrigerant is received from the outdoor heat exchanger and expelled toward a suction side of a refrigerant circuit compressor (via a reversing valve), in a heating mode. The chamber of the compensator may be communicatively coupled (e.g., via tubing) to the refrigerant circuit at a position along the refrigerant circuit that is upstream (during the heating mode of operation) of the outdoor heat exchanger such that refrigerant can accumulate in the chamber instead of entering the outdoor heat exchanger in the heating mode. Indeed, during heating mode, the refrigerant passing out of the outdoor heat exchanger and through the conduit of the compensator will be relatively cold, which lowers pressure in the chamber of the compensator, which pulls the refrigerant from upstream of the outdoor heat exchanger into the chamber of the compensator. In contrast, when the system is operating in cooling mode, the refrigerant passing through the conduit will be relatively hot because it is being received from the outlet of the compressor via the reversing valve. This causes the chamber of the compensator to be heated and an associated higher pressure within the chamber, which pushes refrigerant out of the chamber. Thus, during heating mode, excess refrigerant is stored in the chamber while in the cooling mode essentially the full refrigerant charge is being employed, as designed.

Typically, indoor heat exchangers are tube and fin heat exchangers. That is, indoor heat exchanger typically include tubing with fins thermally coupled thereto such that heat transfer operations are improved (e.g., based on the increased surface area provided by the fins). However, while present embodiments may employ a tube and fin design, present embodiments may also employ a microchannel design. For example, instead of using a tube and fin heat exchanger as the indoor heat exchanger, the indoor heat exchanger may include microchannel tubes. Microchannel tubes are generally formed from extrusion and may also be referred to as multi-channel extrusions. Microchannel tubes often have a rectangular cross-section with several channels formed there through such that heat transfer is improved based on a higher surface per volume ratio. By employing microchannel tubes instead of tube and fin designs, present embodiments may facilitate use of a smaller heat exchanger that is equally as efficient or more efficient (e.g., uses less refrigerant and improves heat transfer efficiency). However, it is now recognized that, when using a microchannel tube heat exchanger as the indoor heat exchanger in a heat pump, system adjustments may be employed to facilitate desired operation and accommodate certain secondary functional differences (e.g., additional stacking of refrigerant in the system during heating mode operation). Present embodiments may include positioning a compensator (e.g., to the indoor heat exchanger) or multiple compensators in a manner (e.g., within a coil assembly plate or delta plate) that conserves space while still providing desired functionalities.

While it is now recognized that utilizing a microchannel tube heat exchanger as the indoor heat exchanger and adding a compensator has clear advantages over traditional systems, it is further recognized that other challengers are created. For example, installing a refrigerant charge compensator or an additional refrigerant charge compensator may be a challenge due to limited availability of space. As a specific example, installation of a compensator with the indoor heat exchanger and/or the outdoor heat exchanger may be difficult because there may be size limitations (e.g., to facilitate installation, due to required specifications, because of industry standards, or the like). Indeed, the geometry of the heat exchangers (e.g., the indoor heat exchanger) and associated features (e.g., housing) may have limited available space. Further, airflow efficiency through the heat exchangers must be taken into consideration because certain placements of the compensator may create substantial interference with airflow over the respective heat exchanger, which may deplete heat exchange efficiency. For example, coils of an indoor and/or outdoor heat exchanger typically extend between coil assembly plates (e.g., delta plates) and the space between the boundaries (e.g., door and walls) of a typical housing and the coil assembly plates is approximately 2 or 3 inches, which is not sufficient for incorporating a typical compensator. Additionally, space between slabs (coils) of a particular heat exchanger or between housing boundaries and the slabs facilitate the airflow for heat transfer, which should not be substantially blocked (e.g., by positioning an entire compensator therein).

In view of the foregoing, present embodiments incorporate a receptacle (e.g., a cutout, opening, recess, indentation) in or through the coil assembly plate (e.g., delta plate) to accommodate the compensator with the heat exchanger. While the present disclosure focuses on such a receptacle being included in a coil assembly plate of a multichannel heat exchanger due to relevant operational characteristics and benefits, present embodiments may include such a receptacle formed in a coil assembly plate for any type of indoor or outdoor heat exchanger. Indeed, present embodiments may generate spatial efficiency in numerous different configuration types. By employing a receptacle within a coil assembly plate to accommodate a compensator, as will be discussed in detail below, present embodiments may facilitate spatial efficiency and operational efficiency.

Turning now to the drawings, FIG. 1 illustrates a heating, ventilation, and/or air conditioning (HVAC) system for building environmental management that may employ one or more HVAC units incorporating embodiments of the present disclosure. In the illustrated embodiment, a building 10 is cooled and/or warmed by a system that includes a HVAC unit 12, which may include a heat pump with a compensator spatially accommodated within a coil assembly plate in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 2, which includes an outdoor HVAC unit 58 and an indoor HVAC unit 56. As discussed below, present embodiments may provide particular benefits for microchannel heat exchangers of indoor units, such as the indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. Present embodiments may provide specific benefits to a heat pump operating in a heating mode. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
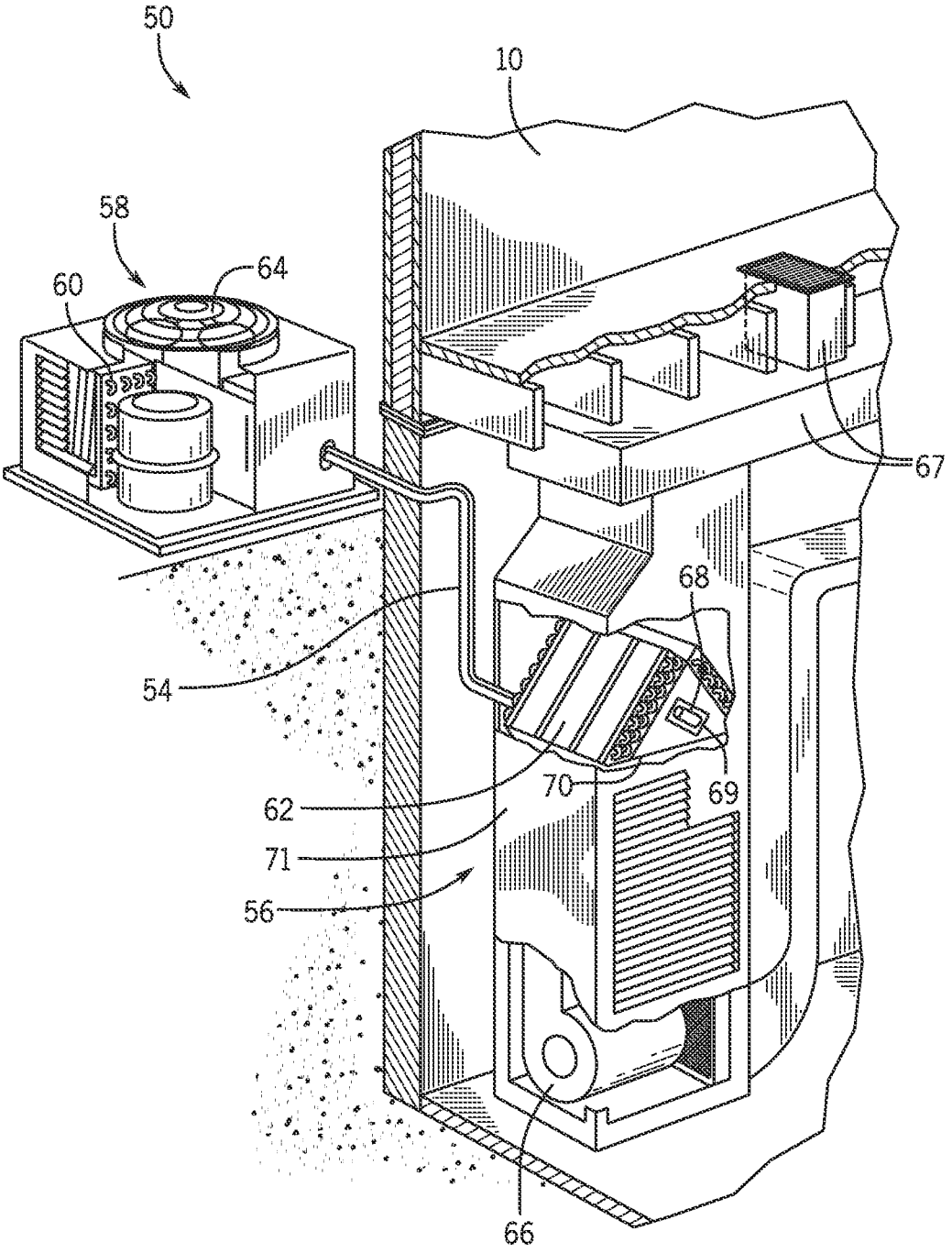
FIG. 2 is a perspective view of a split HVAC system, which may be utilized with a residence or the building of FIG. 1, in accordance with an embodiment of the present disclosure.

FIG. 2 illustrates an embodiment of a residential heating and cooling system 50, in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. Moreover, as mentioned above, the HVAC unit 12 of FIG. 1 may be implemented as a split HVAC system. In general, the building 10 (e.g., residence, commercial building) conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of building 10 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 2 is operating as an air conditioner, a heat exchanger 60 (also referred to as outdoor heat exchanger 60) in the outdoor unit 58 serves as a condenser for re-condensing vaporized refrigerant flowing from the indoor unit 56 to the outdoor unit 58 via one of the refrigerant conduits 54. In these applications, a heat exchanger 62 (also referred to as indoor heat exchanger 62) of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 67 that directs the air to the building 10. The overall system operates to maintain a desired temperature as set by a system controller, such as the control device 16 discussed above. When the temperature sensed inside the building 10 is higher than the set point on the control device 16, or the set point plus a small amount, the residential heating and cooling system 50 may become operative to refrigerate additional air for circulation through the building 10. When the temperature reaches the set point, or the set point minus a small amount, the residential heating and cooling system 50 may stop the refrigeration cycle temporarily.

As a heat pump, the residential heating and cooling system 50 may also operate in a heating mode. When operating in a heating mode of a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant. In the heating mode, the operating conditions and the size of the indoor heat exchanger 62 may cause refrigerant to stack up in the residential heating and cooling system 50. While the illustrated embodiment shows the indoor heat exchanger 62 as a fin and tube exchanger, in some embodiments the indoor heat exchanger 62 may be a microchannel tube heat exchanger, which may exacerbate this issue. Indeed, the small channels of a microchannel tube heat exchanger tend to have a more limited volume. Accordingly, to accommodate this, present embodiments may incorporate a compensator 68 within a compensator receptacle 69 of a coil assembly plate 70 (e.g., delta plate) of the indoor heat exchanger 62. Because the indoor unit 56 has limited available space, incorporating this feature allows for employment of the compensator 68 without a substantial impact on size or performance. Indeed, even an overall footprint of the indoor heat exchanger 62 may not be extended such that there is no interference with an outer skin 71 of the indoor unit 56.

The overall system operates to maintain a desired temperature as set by the control device 16 (e.g., thermostat), in certain embodiments. For example, in a cooling mode of operation, when the temperature sensed inside the building 10 is higher than the set point on the control device 16 (plus a small amount), the air conditioner may operate to refrigerate additional air for circulation through the building 10. When the temperature reaches the set point (minus a small amount), the unit may stop the refrigeration cycle temporarily.

Figure 3:
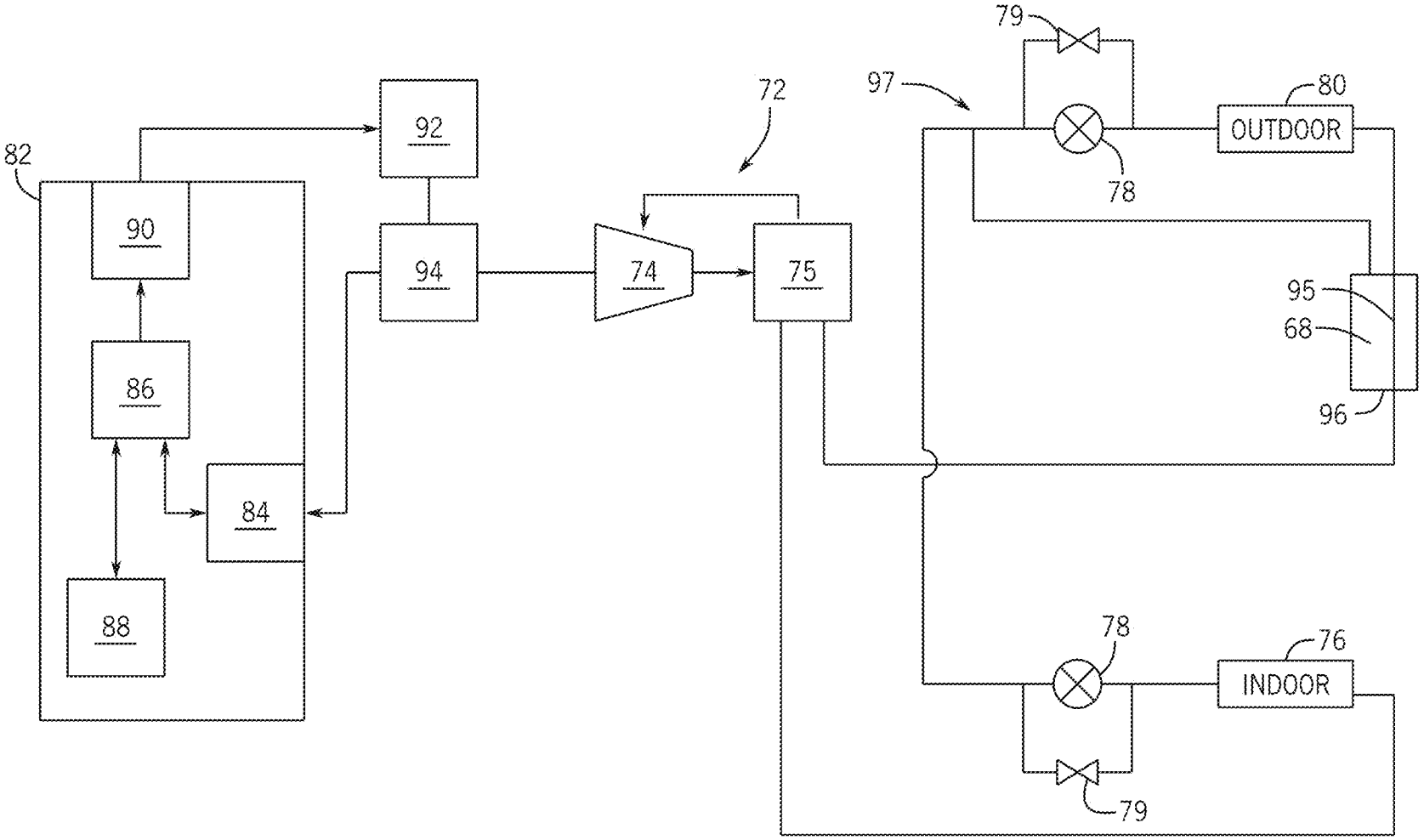
FIG. 3 is a schematic diagram of an embodiment of a refrigeration system having an efficiently positioned compensator to conserve space, in accordance with an embodiment of the present disclosure.

FIG. 3 is an embodiment of a vapor compression system 72 that can be used in any of the systems described above. The vapor compression system 72 may include a heat pump system that operates to circulate a refrigerant through a circuit starting with a compressor 74. The circuit may also include a switching valve 75, an indoor heat exchanger 76, expansion valves 78 (also referred to as expansion devices 78), non-return valves 79, an outdoor heat exchanger 80, and the compensator 68. The expansion valves 78 and non-return valves 79 cooperate to block flow of refrigerant from proceeding backwards through the expansion valves 79, which are positioned for operation in different modes (e.g., the expansion valve 79 adjacent the outdoor heat exchanger 80 operates in heating mode). The compensator 68 may be integrated or otherwise stored within a coil assembly plate of the indoor heat exchanger 76 or the outdoor heat exchanger 80, in accordance with present embodiments.

The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth. Further, the control panel 82 may control certain aspects of operation based on system layout, such as where the compensator 68 (or another compensator) is located and the nature (e.g., fin and tube or microchannel) of relevant heat exchangers.

In some embodiments, the vapor compression system 72 may use one or more of a variable speed drive (VSDs) 92, a motor 94, the compressor 74, the indoor heat exchanger 76, the expansion valve or device 78, and/or the outdoor heat exchanger 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 (e.g., a centrifugal compressor) compresses a refrigerant vapor and delivers the vapor to the switching valve 75. In a cooling mode, the switching valve 75 directs the refrigerant to the outdoor heat exchanger 80 through the compensator 68. The refrigerant vapor delivered by the compressor 74 to the outdoor heat exchanger 80 may transfer heat to a fluid passing across the outdoor heat exchanger 80, such as ambient or environmental air. The refrigerant vapor may condense to a refrigerant liquid in the outdoor heat exchanger 80 (operating as a condenser) as a result of thermal heat transfer with the environmental air. The liquid refrigerant from the outdoor heat exchanger 80 may flow through the expansion device 78 downstream of the outdoor heat exchanger 80 on its way to the indoor heat exchanger 76.

The liquid refrigerant delivered to the indoor heat exchanger 76 may absorb heat from another air stream, such as a supply air stream provided to the building. For example, the supply air stream may include ambient or environmental air, return air from a building, or a combination of the two. The liquid refrigerant in the indoor heat exchanger 76 (operating as an evaporator) may undergo a phase change from the liquid refrigerant to a refrigerant vapor. In this manner, indoor heat exchanger 76 may reduce the temperature of the supply air stream via thermal heat transfer with the refrigerant. Thereafter, the vapor refrigerant exits the indoor heat exchanger and returns to the compressor 74 by a suction line to complete the cycle.

During operation of the vapor compression system 72 in a cooling mode, the refrigerant passing through a conduit 95 of the compensator 68 may be relatively hot. Accordingly, a chamber 96 of the compensator 68 disposed about the conduit 95 may also be relatively warm. Thus, the chamber 96 will not operate to pull refrigerant into it from another location 97 along the refrigerant circuit, such as from between an exit of the outdoor heat exchanger 80 and an entry into the indoor heat exchanger 76 where the chamber 96 is connected in the illustrated embodiment. However, in a heating mode of operation, the reversing valve 75 operates to reverse the flow of refrigerant such that the outdoor heat exchanger 80 operates as the evaporator and the indoor heat exchanger 76 operates as the condenser. In this mode of operation, the refrigerant passing through the conduit 95 is relatively cold having just passed the expansion valve 79 entering the outdoor heat exchanger 80 and then passing through the outdoor heat exchanger 80 itself, while it is operating as an evaporator. Accordingly, refrigerant backed up toward the indoor heat exchanger 76, while operating in the heating mode, may be pulled into the chamber 96 based on a cooling effect within the chamber 96.

As noted above, the compensator 68 may be stored or located within a receptacle of a coil assembly plate (e.g., a delta plate) of one of the indoor heat exchanger 76, the outdoor heat exchanger 80, or both. Hot air from an indoor space may blow across the indoor heat exchanger 76 (e.g., in a cooling mode) and the compensator 68, which may push liquid refrigerant out of the compensator 68 (out of the chamber 96) or cold air from the indoor space blowing across the heat exchanger 76 (e.g., in a heating mode) and compensator 68 may pull liquid refrigerant into the compensator 68 (into the chamber 96). Further, multiple compensators 68 may be employed with different source points along the refrigerant circuit for supplying the chamber 96 where appropriate and under desired operating conditions.

As used herein, "refrigerant" refers to any operating fluid contained within the vapor compression system 72 and employed to facilitate cooling, including any suitable refrigerant or refrigerant mixture having additives such as oils, indicators, stabilizers, dyes, fragrances, or any combination thereof. The term "refrigerant" may broadly reference commercial refrigerants and may exclude contaminants, such as water.

Figure 4:
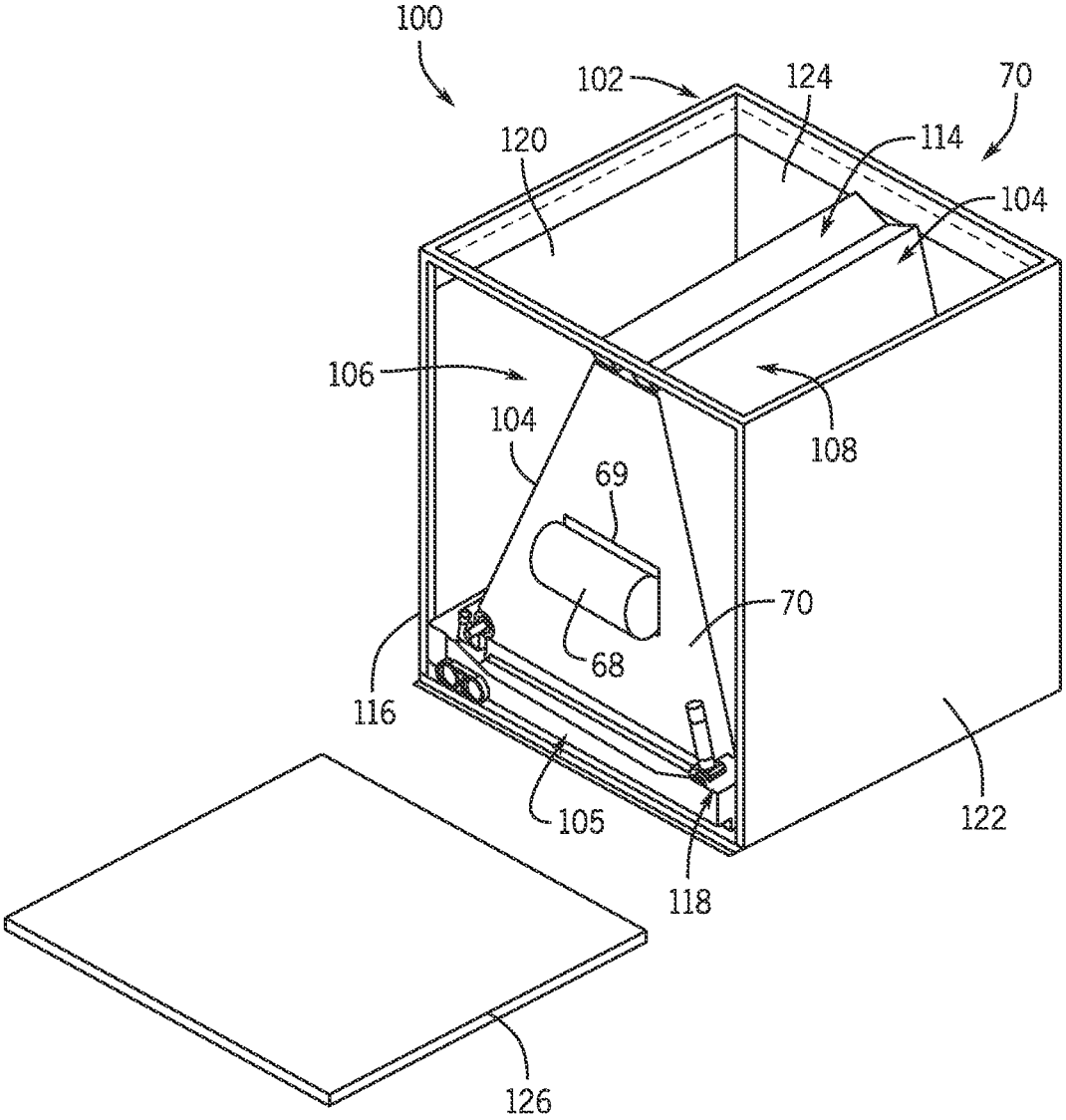
FIG. 4 is a perspective view of an embodiment of a heat exchanger, a housing, and a compensator disposed in a coil assembly plate, in accordance with an embodiment of the present disclosure.

FIG. 4 is a perspective view of a portion of an HVAC unit 100 according to an embodiment of the present disclosure. Specifically, the illustrated portion of the HVAC unit 100 may represent a housing 102 with a coil assembly 104 disposed therein. The coil assembly 104 may correspond to the indoor heat exchanger 62 of FIG. 2 and the housing 102 may correspond to a portion of the outer skin 71 of the indoor unit 56. In some embodiments, the coil assembly 104 may be a fin and tube or microchannel heat exchanger that is configured to receive chilled refrigerant or other liquid through tubes 103 to condense, cool, and/or dehumidify air that moves across the tubes 103. Particularly, the air may be pulled or forced across the tubes 103 by an air mover, such as the blower or fan 66 to facilitate heat exchange operations to achieve desired climate management of an indoor space. The coil assembly 104 and related components of the housing 102 may be installed in a particular position that suits a desired operation. For example, the illustrated portion of the HVAC unit 100 may be designed for up-flow. However, in other orientations, it may facilitate down-flow, horizontal right-flow, or horizontal left-flow. Up-flow, down-flow, horizontal right-flow, and horizontal left-flow describe paths that air may flow relative to the coil assembly. Other flow paths are also presently contemplated.

The coil assembly 104, depending on orientation, may be considered an A-type coil assembly or a V-type coil assembly. Indeed, the coil assembly 104 includes a pair of heat exchanger slabs that generally form an A-shape or V-shape because they essentially come together at one side creating a triangular shape. It is to be understood the present embodiments are not limited to such embodiments and may be implemented with other types of coil assemblies as well, such as an N-type coil assembly. However, for ease of discussion, the illustrated and discussed examples focus on an A-type coil assembly.

Although, FIG. 4 illustrates what is generally referred to as a vertically oriented coil assembly 104, which facilitates up-flow discharge of air or down-flow discharge of air through the coil assembly 104, it is to be understood that present embodiments can be employed in any orientation. In one example, a vertically oriented coil assembly may be employed to provide upward discharge of air for transferring heated air inside an enclosed space during cold climate or downward discharge of air (e.g., in a rooftop installation) for transferring cold air inside an enclosed space during warm climate. The coil assembly 104 may represent a tube and fin heat exchanger, a microchannel tube heat exchanger, or another type of heat exchanger slab. While only certain aspects are illustrated and described in detail, the illustrated portion of the HVAC unit 100 can include additional components that facilitate operations.

In addition to the coil assembly 104, the illustrated embodiment includes a drain pan 105. As air moves across the coil assembly 104 to achieve the heat exchange discussed above, moisture or water within the air may condense and gather about tubes of the coil assembly 104. As the water from the air continues to condense, the condensate or condensed water may drop along the first slab 106 and/or the second slab 108 into the drain pan 105, which is positioned vertically below the coil assembly 104. In certain embodiments, an air mover may blow or draw the condensate off of the coil assembly 104 and into the drain pan 105. In other embodiments, the condensate may be pulled into the drain pan 105 by gravity.

As noted above, the coil assembly 104 is an A-type coil assembly. The coil assembly includes a first slab 106 and a second slab 108, which are coupled together via a couple of coil assembly plates 70 (also referred to as delta plates 70). Only the front coil assembly plate 70 is clearly visible in the depicted perspective. In addition to the first slab 106 and the second slab 108, the coil assembly 104 includes an apex end 114, a first end 116, and a second end 118. The apex end 114 is defined as abutting ends or proximate ends of the first slab 106 and the second slab 108. The first end 116 is an end of the first slab 106 that is opposite of the apex end 114. Similarly, the second end 118 is an end of the second slab 108 that is opposite of the apex end 114. Both the first end 116 and the second end 118 are spaced apart from each other.

The coil assembly 104 is coupled with and supported by the pair of coil assembly plates 70. The coil assembly plates 70 are provided on either side of the coil assembly 104. Only one of the coil assembly plates 70 (referred to as the front assembly plate 70) is clearly visible in FIG. 4. The coil assembly plates 70 couple with the first slab 106 and the second slab 108 such that they hold the first slab 106 and the second slab 108 together, thus providing general structural support. However, the coil assembly plates 70 also function to direct air flowing through the portion of the HVAC unit 100 through the coil assembly 104 to encourage proper heat exchange. Indeed, the coil assembly plates 70 cooperate to guide airflow through the first slab 106 and the second slab 108 and prevent airflow from escaping through what would otherwise be an opening to bypass the coil assembly 104. In an embodiment, the first end 116 of the first slab 106 and the second end 118 of the second slab 108 are coupled to the drain pan 105 or any other suitable support structure of the housing 102.

As discussed above, refrigerant may stack up due to certain system operations. For example, in the heating mode of a heat pump utilizing the coil assembly 104 as an indoor coil, may cause refrigerant in liquid form to fill portions of the system. This may be exacerbated when the coil assembly 104 is a microchannel tube heat exchanger. Accordingly, to accommodate this, present embodiments may incorporate one or more compensators 68. Specifically, in the illustrated embodiment the compensator 68 is disposed within the compensator receptacle 69 of the coil assembly plate 70, which is positioned in alignment with boundaries the housing 102. In the illustrated embodiment, the compensator 68 and the associated compensator receptacle 69 may be described as positioned horizontally (e.g., transverse to the direction of airflow exiting through a top of the coil assembly 104). However, in other embodiments, the compensator 68 and the compensator receptacle 69 may be positioned in any orientation that avoids impacting (e.g., deforming) heat exchange tubes. Because the housing 102 has limited available space, incorporating the compensator 68 in the compensator receptacle 69 in this manner (i.e., extending through the coil assembly plate 70) allows for improved system operation (as provide by use of the compensator 68) without a substantial impact on size or performance. For example, the compensator 68 is positioned within the boundaries or an envelope of the housing 102 and does not substantially interfere with airflow therethrough.

The housing 102 in FIG. 4 is shown to include a plurality of panels that engage with the drain pan 105. Specifically, the housing 102 is illustrated as including a first panel 120, a second panel 122, and a third panel 124. The housing 102 may be provided with one or more access panels 126 configured to engage with the first panel 120 and the second panel 122. The first panel 120 and the second panel 122 are substantially parallel to each other, whereas the third panel 124 and the access panel 126 are substantially parallel to each other when the access panel 126 is in an installed configuration. The third panel 124 is substantially orthogonal to the first panel 120 and the second panel 122. For example, the shape of housing 102 can be of rectangular shape, cubic shape, and any other geometrical shape. In another example, the first panel 120, the second panel 122, and the third panel 124 may have a C-shaped profile or U-shaped profile. In a configuration in which the access panel 126 is removed, as shown in the illustrated embodiment, the compensator 68 can be accessed (e.g., for maintenance). When the access panel 126 is installed, the positioning of the compensator 68 within the compensator receptacle 69 (e.g., an opening or an indentation) of the coil assembly plate 70 may prevent the compensator from substantially engaging with (e.g., deforming the access panel 126 or any other panel of the housing 102). In some embodiments, the access panel 126 or some other panel of the housing 102 may be designed to accommodate some minor outward extension of the compensator 68 from the coil assembly plate 70.

Figure 5:
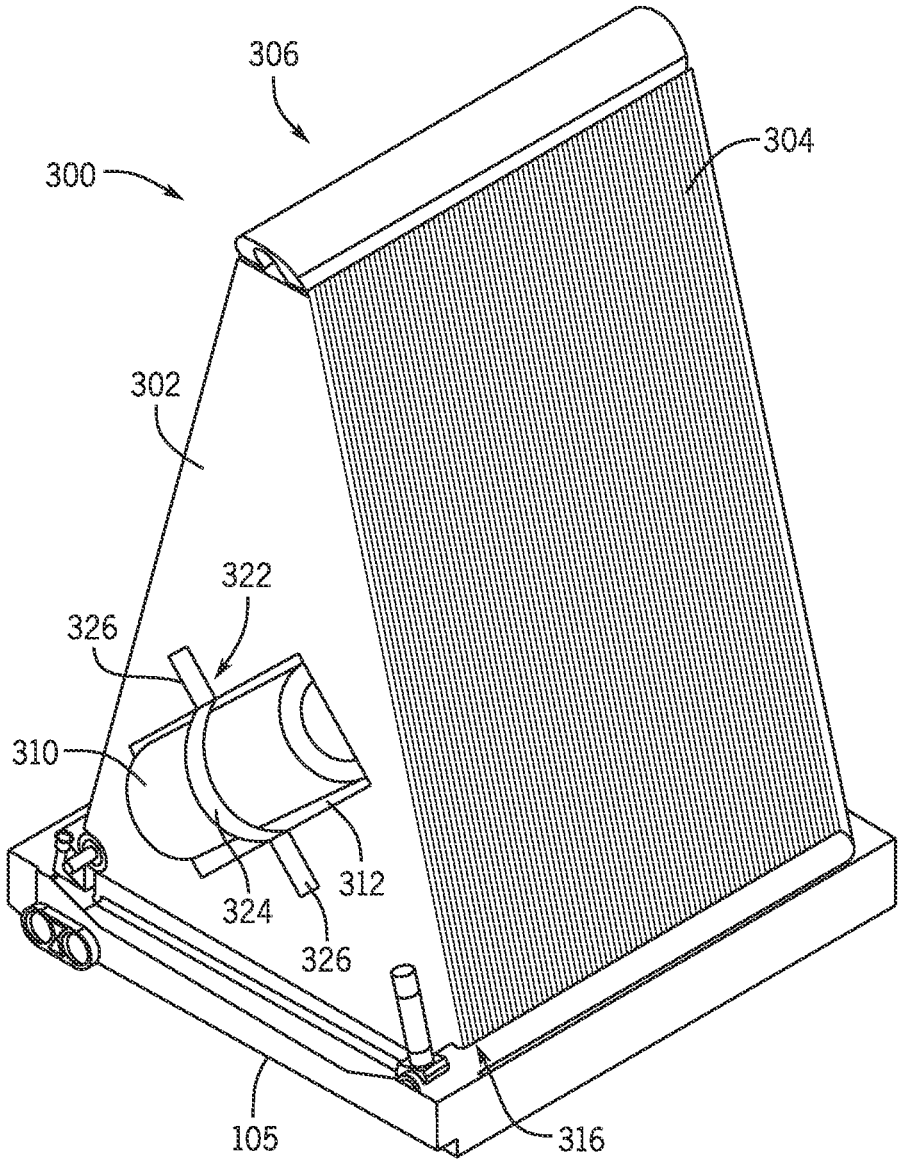
FIG. 5 is a perspective view of an embodiment of a microchannel heat exchanger and a compensator disposed in a coil assembly plate, in accordance with an embodiment of the present disclosure.

FIG. 5 is a perspective view of a microchannel indoor coil 300 (indoor heat exchanger) in accordance with an embodiment of the present disclosure. The indoor coil 300 may be employed as the coil assembly 104. A delta plate 302, such as one of the pair of delta plates 70, is disposed between first slab 304 and second slab 306 of the indoor coil 300. Further, the delta plate 302 houses a compensator 310. Specifically, the delta plate 302 includes a receptacle 312 in which the compensator 310 is disposed. The receptacle 312 may include an opening that passes entirely through the delta plate 70 or a recess (e.g., an indentation) in the delta plate 302. Using a recess instead of an opening as the receptacle 312 may relatively limit airflow escape through the delta plate 302 compared to a full opening.

In the illustrated embodiment, the delta plate 302 is secured over end sheets 316 of the indoor coil 300. The end sheets 316 run along a perimeter of the delta plate 302. The receptacle 312 (e.g., a notch or recess) is located in an interior area of the delta plate 302 so that the receptacle 312 does not puncture or deform the end sheets 316 (e.g., microchannel tubes on the outer edges of the slabs 304, 306). The location, shape, and depth of the receptacle 312 is configured to fit the compensator 310 without having to modify an associated housing (e.g., the housing 102). The receptacle 312 is enabled to at least partially receive the compensator 310 therein. For example, a distance between housing doors (e.g., access panel 126) and the delta plate 302 may be fixed (e.g., approximately 2 or 3 inches). This fixed distance may be used to determine the maximum protrusion of the compensator 310 from a surface of the delta plate 302, and, in turn, determine the depth of receptacle 312 or a coupling position of the compensator 310 within the receptacle 312 (e.g., when the receptacle 312 is a hole that passes entirely through the delta plate 302). The receptacle 312 may be designed to correspond to the size, shape, and dimensions of a compensator to prevent excess air from escaping through the receptacle 312 and to keep the air flowing across the microchannel slabs 304, 306. In some embodiments, the receptacle 312 is cut, shaped, or impressed into the delta plate 312. For example, the receptacle 312 may be an opening or a whole that is not big enough to allow the compensator 310 to completely pass therethrough (e.g., a height of the receptacle 312 may be smaller than a diameter of the compensator 310). The receptacle may be in the shape of a rectangle, a square, an oval, a triangle, a polygon, a circle, or any geometric shape that correlates to a profile of the compensator 310 and allows engagement therewith. In the illustrated embodiment, the receptacle 312 is oriented at an angle relative to the drain pan 105. However, in accordance with present embodiments, the receptacle 312 may be oriented in any direction and located anywhere in the delta plate 302.

In the illustrated embodiment, a bracket 322 is affixed to the delta plate 302 to secure, stabilize, and/or lock down the charge compensator 310 in the receptacle 312. The bracket 322 is configured to hold the charge compensator in the receptacle 4312 and/or against the delta plate 302. The bracket 322 can be removably affixed to either side of the delta plate 302 and proximate the receptacle 312. The bracket 322 may represent multiple such brackets and brackets may be employed on both sides of the delta plate 302 when the receptacle is an opening that passes completely through the delta plate 302. The bracket 322 and the receptacle 312 can be made from any materials including metals commonly used to manufacture the delta plate, i.e., stainless steel, aluminum, etc. The receptacle 312 may be formed from the delta plate 302 (e.g. impressed into the delta plate, cut through the delta plate) but may also be separately formed and attached to the delta plate 302 (e.g., a recess formed in plastic or metal and secured through a separate opening through the delta plate 302).

In the illustrated embodiment of FIG. 5, the receptacle 312 is an angled rectangular hole cut into an interior of the delta plate 302. The dimensions of the receptacle 312 are sized to the length and diameter of the charge compensator 310 and the receptacle 312 opens to the inside space between the microchannel slabs 304, 306. The compensator 310 lies lengthwise in the hole, with circular ends of the compensator 310 abutting or adjacent (e.g., less than an inch away) from the edges at the width of the receptacle 312.

In the illustrated embodiment, the bracket 322 is a strip of stainless steel or aluminum. A middle portion 324 of the bracket 322 juts out and follows a contour (e.g., a curved circumference) of the compensator 310. The bracket's curved length (the middle portion 324) abuts the compensator's round perimeter surface. Flat ends 326 of the bracket lie against a surface of the delta plate 302 and couple thereto. For example, each of the flat ends 326 of the bracket may have holes that receive screws or other fasteners that extend therethrough and into the delta plate 302. Thus, the bracket 322 may be secured directly to delate plate 302 and retain the compensator 310 in the receptacle 312. In some embodiments, a first bracket is coupled to an outside surface of the delta plate 302 and another bracket is coupled to an inside surface of the delta plate 302. In other embodiments, more than one bracket may be positioned on each side of the delta plate 302.

Figure 6:
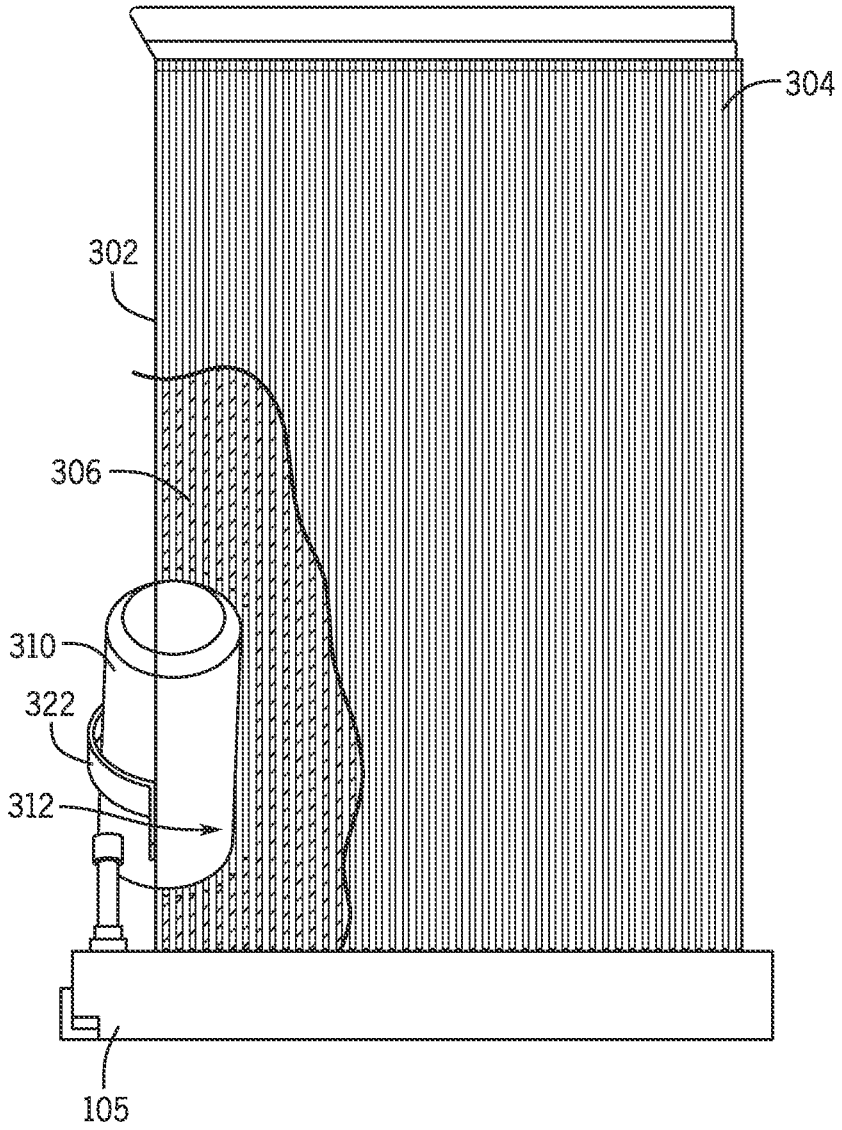
FIG. 6 is a side view of an embodiment of a microchannel heat exchanger and a compensator disposed in an indentation or mold within a coil assembly plate, in accordance with an embodiment of the present disclosure.

FIG. 6 is a cross-sectional side view of the indoor coil 300, wherein the receptacle 312 is an indentation (e.g., a pressed or stamped form that is disposed in or coupled to the delta plate 302), in accordance with an embodiment of the present disclosure. The receptacle 312 of FIG. 6 is essentially a depression or recess in the surface of the delta plate 302 that operates to house approximately half of the compensator 310 such that the rest of the compensator extends outwardly from the delta plate 302 (and from the receptacle 312) toward a boundary (e.g., a footprint perimeter defined by edges of the drain plate 105) of the indoor coil 300. Instead of a hole or opening through the delta plate 302 that is open to the inside space between the microchannel slabs, the receptacle 312 illustrated in FIG. 6 is closed off to that space. Thus, airflow through that space may be guided around the compensator 310 and retained within that space by a side of the receptacle 312 facing away from the compensator 310. The bracket 322 is illustrated with a curvature matching a round surface of the compensator 310 and a depth corresponding to the compensator's protrusion into the inside space between the first slap 304 (not shown in FIG. 6) and the second slab 306. As previously noted, in some embodiments, the receptacle 312 is a separately formed piece that is secured within an opening through the delta plate 302 such that the receptacle 312 blocks air from passing through the opening in the delta plate 302 from an the inside space between the slabs 304, 306, while acting as a "cradle" or "seat" for the compensator 310. While an indentation in the delta plate 302 or a separately formed receptacle 312 may assist in defining the interior space defined by the delta plates 302 and slabs 304, 306, they may be referred to as extending into the space defined by these features, as would be understood by one of ordinary skill in the art.

In some embodiments, more than one compensator is installed. A single receptacle can be made to house multiple compensators or separate receptacles may be made for each of several compensators. Similarly, one bracket with a longer extended projected middle portion may be employed to encompass multiple compensators or multiple brackets can be made to accommodate multiple compensators.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope While only certain features and embodiments of the present disclosure have been illustrated and described, many modifications and changes may occur to those skilled in the art, such as variations in sizes, dimensions, structures, shapes and proportions of the various elements, values of parameters including temperatures, pressures, and so forth, mounting arrangements, use of materials, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described, such as those unrelated to the presently contemplated best mode of carrying out the disclosure, or those unrelated to enabling the claimed features. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a refrigerant circuit configured to circulate refrigerant therethrough, the refrigerant circuit comprising a compressor, an indoor heat exchanger, an outdoor heat exchanger, and a reversing valve configured to transition between a first configuration to direct the refrigerant from the compressor toward the outdoor heat exchanger and a second configuration to direct the refrigerant from the compressor toward the indoor heat exchanger;

a refrigerant charge compensator;

a conduit of the refrigerant charge compensator, wherein the conduit is part of the refrigerant circuit and configured to pass the refrigerant therethrough;

a chamber of the refrigerant charge compensator, wherein the chamber is disposed about the conduit, communicatively coupled to the refrigerant circuit, and configured to retain a portion of the refrigerant therein; and a coil assembly plate of the indoor heat exchanger or the outdoor heat exchanger, wherein the coil assembly plate comprises a receptacle configured to receive the refrigerant charge compensator.

2. The HVAC system of claim 1, wherein the indoor heat exchanger comprises a microchannel tube heat exchanger.

3. The HVAC system of claim 1, wherein the coil assembly plate is one of a pair of coil assembly plates that couple with a first slab and a second slab of the indoor heat exchanger or the outdoor heat exchanger and cooperate to guide airflow through the indoor heat exchanger or the outdoor heat exchanger.

4. The HVAC system of claim 1, wherein the receptacle comprises a hole through the coil assembly plate with dimensions corresponding to a perimeter of the refrigerant charge compensator.

5. The HVAC system of claim 1, wherein the receptacle comprises an indentation in the coil assembly plate with dimensions of the indentation corresponding to dimensions of the refrigerant charge compensator.

6. The HVAC system of claim 1, wherein the receptacle comprises a molded form defining a recess with dimensions of the recess corresponding to dimensions of the refrigerant charge compensator, wherein the molded form couples with the coil assembly plate and extends through an opening in the coil assembly plate.

7. The HVAC system of claim 1, wherein the indoor heat exchanger is a microchannel heat exchanger and the coil assembly plate is coupled with or part of the indoor heat exchanger.

8. The HVAC system of claim 1, wherein the refrigerant charge compensator is positioned within the receptacle such that the refrigerant charge compensator does not extend beyond a footprint or envelope defined by the indoor heat exchanger or the outdoor heat exchanger.

9. The HVAC system of claim 8, wherein the footprint or envelope is defined by a drain pan or a housing of the indoor heat exchanger or the outdoor heat exchanger.

10. The HVAC system of claim 1, wherein the receptacle is angled such that a surface or the receptacle or the refrigerant charge compensator will not touch any tubes of the indoor heat exchanger or the outdoor heat exchanger.

11. The HVAC system of claim 1, wherein the refrigerant charge compensator is configured to receive the refrigerant into the conduit from the compressor and pass the refrigerant into the outdoor heat exchanger in a cooling mode.

12. The HVAC system of claim 11, wherein the chamber of the refrigerant charge compensator is fluidly coupled to the refrigerant circuit via communicative coupling between the outdoor heat exchanger and the indoor heat exchanger.

13. A heat pump system, comprising a compressor of a refrigeration circuit, wherein the compressor is configured to drive refrigerant through the refrigeration circuit;

an indoor heat exchanger of the refrigeration circuit;

an outdoor heat exchanger of the refrigeration circuit;

a reversing valve of the refrigeration circuit, wherein the reversing valve is configured to transition between a first configuration to direct the refrigerant from the compressor toward the outdoor heat exchanger and a second configuration to direct the refrigerant from the compressor toward the indoor heat exchanger;

a refrigerant charge compensator comprising a conduit disposed along the refrigerant circuit and a chamber surrounding the conduit that is fluidly coupled to the refrigerant circuit; and a coil assembly plate of the indoor heat exchanger or the outdoor heat exchanger, wherein the coil assembly plate comprises a receptacle configured to receive the refrigerant charge compensator.

14. The heat pump system of claim 13, wherein the coil assembly plate is coupled or integrated with the indoor heat exchanger, which is a microchannel tube heat exchanger.

15. The heat pump system of claim 13, wherein the receptacle comprises a hole through the coil assembly plate with dimensions corresponding to a perimeter of the refrigerant charge compensator.

16. The heat pump system of claim 13, wherein the receptacle comprises an indentation in the coil assembly plate with dimensions of the indentation corresponding to dimensions of the refrigerant charge compensator.

17. The heat pump system of claim 13, wherein the receptacle comprises a molded form defining a recess with dimensions of the recess corresponding to dimensions of the refrigerant charge compensator, wherein the molded form couples with the coil assembly plate and extends through an opening in the coil assembly plate.

18. A heating, ventilation, and/or air conditioning (HVAC) system, comprising:

a heat exchanger;

a first slab of the heat exchanger;

a second slab of the heat exchanger;

coil assembly plates coupled to the first slab and the second slab such that an interior space is defined between the first slab, the second slab, and the coil assembly plates, wherein the interior space is configured to guide airflow through the heat exchanger; and a receptacle in one coil assembly plate of the coil assembly plates, wherein the receptacle houses a refrigerant charge compensator such that a portion of the refrigerant charge compensator extends into the interior space.

19. The HVAC system of claim 18, wherein the receptacle comprises a form or indentation that extends into the interior space and cradles the refrigerant charge compensator.

20. The HVAC system of claim 18, wherein the first slab and the second slab comprises microchannel tubes.

* * * * *